US006260996B1

(12) United States Patent
Coleman, Jr.

(10) Patent No.: US 6,260,996 B1
(45) Date of Patent: Jul. 17, 2001

(54) HOURGLASS WITH BYPASS DUCT

(76) Inventor: Richard K. Coleman, Jr., 22 Viking Dr., Englewood, CO (US) 80110

( * ) Notice: Subject to any disclaimer, the term of this patent is extended or adjusted under 35 U.S.C. 154(b) by 0 days.

(21) Appl. No.: 09/494,226

(22) Filed: Jan. 27, 2000

(51) Int. Cl.[7] ..... G04F 1/04
(52) U.S. Cl. ..... 368/93
(58) Field of Search ..... 368/93–95

(56) References Cited

U.S. PATENT DOCUMENTS

| | | | | |
|---|---|---|---|---|
| 441,661 | | 12/1890 | Hawley . | |
| 2,199,645 | * | 5/1940 | McGehee | 368/93 |
| 3,125,849 | | 3/1964 | Wachtel . | |
| 3,505,873 | * | 4/1970 | Cornelsion et al. | 368/93 |
| 5,023,852 | | 6/1991 | Mikels . | |

FOREIGN PATENT DOCUMENTS

| | | | |
|---|---|---|---|
| 623530 | | 12/1935 | (DE) . |
| 1209552 | * | 3/1960 | (FR) . |
| 2646253 | * | 10/1990 | (FR) . |
| 10156 | | of 1884 | (GB) . |
| 15574 | | of 1889 | (GB) . |
| 23894 | | of 1894 | (GB) . |
| 89/00721 | * | 1/1989 | (WO) . |

* cited by examiner

*Primary Examiner*—Vit Miska
(74) *Attorney, Agent, or Firm*—Ramon L. Pizzaro; Edwin H. Crabtree

(57) ABSTRACT

An hourglass that includes a mechanism for varying the amount of time measured with the hourglass. The hourglass includes a pair of reservoirs connected a constriction in a conventional manner, and includes a bypass duct that provides fluid communication between the reservoirs.

12 Claims, 2 Drawing Sheets

HOURGLASS WITH BYPASS DUCT

BACKGROUND OF THE INVENTION (a) Field of the Invention

This invention generally relates to a sand type hourglass with a reset mechanism. More particularly, but not by way of limitation, to an hourglass with a return duct that may be used to reset the hourglass by providing a bypass duct around the narrowed portion of the hourglass.

(b) Discussion of Known Art

In spite of great advancements in the development of time keeping mechanisms, the well known hourglass has endured as a robust device with numerous applications. Examples of these applications include the timing of plays, such as in chess, or the timing of cooking processes, such as the proper amount of time required to boil an egg in order to achieve a desired amount of firmness in the cooked egg. However, a serious drawback to the hourglass has been the absence of a mechanism that allows the hourglass to be reset or re-started without having to wait for the sand to complete its transfer from one side of the hourglass to the other.

Examples of known devices include U.S. Pat. No. 441,661 to Hawley, which teaches a clock that is based on a sand clock or hour glass. The hour glass incorporated into the Hawley device includes a valve that provides adjustment for the flow from one of the sand reservoirs. This arrangement, however, does not provide or suggest a solution for the need to reset the clock.

U.S. Pat. No. 3,125,849 to Wachtel teaches yet another hourglass type device. The Wachtel device includes a pair of reservoirs or chambers which are used to hold the sand that is delivered through a narrow duct between the reservoirs. The duct includes ans in-line valve or flow adjustment mechanism that can be used to vary the rate at which the sand flows through the duct. Thus, in order to speed up the flow of the sand from one reservoir to the next, the Wachtel device provides for an adjustment in the flow through the duct.

A more recent invention is taught in U.S. Pat. No. 5,023,852 to Mikels. The Mikels patent recognizes the long felt need to provide a mechanism that allows expedited transfer of the sand from one of the reservoirs on the next. To address this need, the Mikels device includes a valve along the neck or constriction of the hour glass. This valve is movable from a position where the flow of sand is constricted through the neck or duct between the two reservoirs to a position where the neck provides little restriction to the flow. Thus, to reset the hourglass with the Mikels device one simply opens the valve along the neck to allow unimpeded flow through the neck.

A review of known devices taught in foreign patent documents reveals that the intuitive approach at solving the problem of having to wait for an hourglass to complete its cycle is by placing a valve within the constriction between the two reservoirs. For example, German patent no. 623,530 shows a device with a pair of reservoirs connected by a flapper type valve which allows relatively unrestricted flow in one direction while providing the restricted, controlled flow in the opposite direction.

A similar approach at varying the amount of time required to transfer the sand from one reservoir to the next is shown in British patent no. 23,894 to Watkins. The Watkins device includes a pair of reservoirs connected by a neck or constricted duct that allows the controlled flow of sand from one reservoir to the next. The Watkins device is an approach that is very similar to other known devices in that it also uses a valve type mechanism that cooperates with the neck portion to vary the flow through the neck portion of the device.

Known devices that provide a means for determining different amounts of time with an hourglass include British patent no. 10,156, and British patent no. 15,564. Therefore, a review of known devices reveals that there remains a need for an hourglass that can be reset quickly and easily.

Still further, there remains a need for an hour glass that allows the user to measure different periods of time.

Still further, there remains a need for an hourglass that may be easily reset and which does not use a valve along the neck or constriction between the two reservoirs. The inclusion of a valve along the neck can lead to adverse effects in the precision of the device. Still further, the inclusion of a valve along the neck make the entire device vulnerable to fouling due to jamming of the valve by sand that works its way into the moving parts of the valve.

SUMMARY

It has been discovered that the problems left unanswered by known art can be solved by providing an hourglass that includes a bypass duct between the two reservoirs. The bypass duct extends between the two reservoirs along a path that is generally parallel to the neck or constriction found in the known hourglass structure.

According to a highly preferred embodiment of the invention, each of the reservoirs includes a collecting end and a transfer end. A neck extends between the transfer ends of the reservoirs to provide the restricted flow from one reservoir to the next. The disclosed bypass duct extends from the collecting end of one reservoir to the collecting end of the other reservoir. Thus, to reset the clock or hourglass, the user simply tilts the hourglass such that the sand flows into the bypass duct and into the reservoir where the full measure of sand is to be held prior to starting the timing process of allowing the sand to flow from one reservoir to the next through the neck portion.

Additionally, it is contemplated that the bypass duct may be used for providing valving that serves for measuring the amount of sand that is allowed to flow through the device. Therefore, the disclosed invention may be modified to provide adjustability to the amount of time measured with the device. The adjustability may be provided by way of valves, such as a sliding gate or similar non obtrusive valve mechanism.

Still further, it is contemplated that the disclosed invention may include a pair of bypass ducts, each having a one way valve to allow the user to allow some of the sand to remain in one of the bypass ducts without having to manually manipulate a valve or the like.

It is also contemplated that the other decorative shape modifications may be made without departing from the true scope and spirit of the invention. For example, while the bypass duct has been illustrated as curved, it is contemplated that straight sections may be incorporated along the duct or ducts. Still further, the reservoirs have been illustrated with a traditional external hourglass shape, but it is contemplated that these may be formed in any suitable manner for providing an aesthetically pleasing effect or for facilitating the flow to and from the bypass duct or ducts and into the reservoirs.

Still further, the disclosed invention can be easily manufactured without the need to complicate the system by adding valves or other adjustment mechanisms in the throat area of the hour glass. Thus the arrangement produces a quickly resettable hourglass without the need to incorporate moving parts.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which:

FIG. 1 is an elevational view of a highly preferred embodiment of the invention.

FIG. 1A provides an example of the cross sectional area of the collecting end.

FIG. 1B provides an example of the cross sectional area of the transfer end, and serves for providing a comparison of exemplar ratio of cross sectional areas of the components of the disclosed invention.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1A:
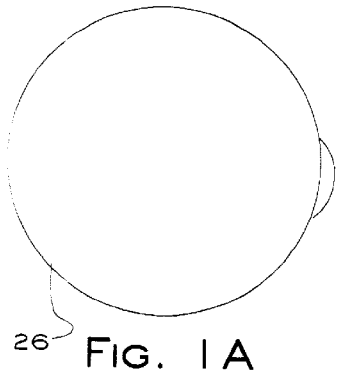
Figure 1B:
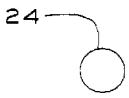
Figure 1:
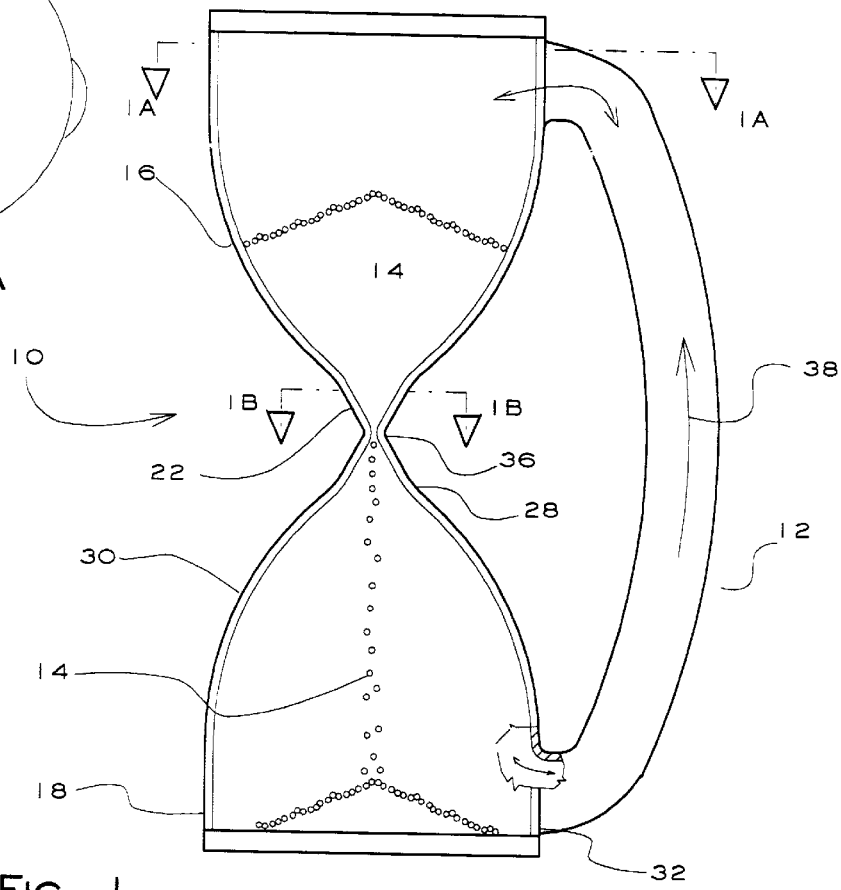

Turning now to FIG. 1 where a highly preferred embodiment of an hourglass 10 which incorporates a bypass duct 12 to allow the hourglass 10 to be reset by the user. It is contemplated that the hourglass 10 will keep time as is well known, and that is by providing an amount of granular material 14, such as sand or the like, and then controlling the flow of the granular material 14 from a first reservoir 16 into a second reservoir 18.

As illustrated on the enclosed figures, the first reservoir 16 includes a collecting end 20 and a transfer end 22. Additionally, the transfer end 22 has a cross sectional area 24, and the collecting end 20 has a cross sectional area 26, graphically represented on FIGS. 1A and 1B. As illustrated, the cross sectional area 24 of the transfer end 22 is smaller than cross sectional area 26 of the collecting end 20 to allow concentration of the granular material about the transfer end 22.

The transfer end 22 of the first reservoir 16 is in fluid communication with a transfer end 28 of a second reservoir 30. The second reservoir 30 also includes a collecting end 32 that is in communication with the transfer end 28 of second reservoir 30. The transfer ends 22 and 28 of the first reservoir 16 and the second reservoir 18 being connected to one another by way of a constriction or necked duct 36. Thus, the transfer end 28 being smaller than the collecting end 32 of the second reservoir, resulting in a corresponding smaller cross sectional area of the transfer end 28 as compared to the collecting end 32 of the second reservoir 30.

As shown on FIGS. 1–5, it is preferred that the bypass duct 12 extend between the collecting end 32 of the first reservoir 16 and the collecting end 32 of the second reservoir 30. According to a highly preferred embodiment of the invention, the flow capacity or cross sectional area of the bypass duct 12 will be much greater than the flow capacity or cross sectional area of the constriction or necked duct 36.

Figure 2:
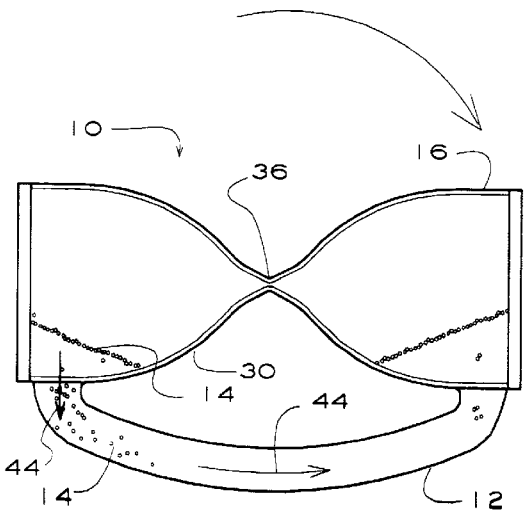
FIG. 2 illustrates the use of the invention to reset the hourglass.
Figure 3:
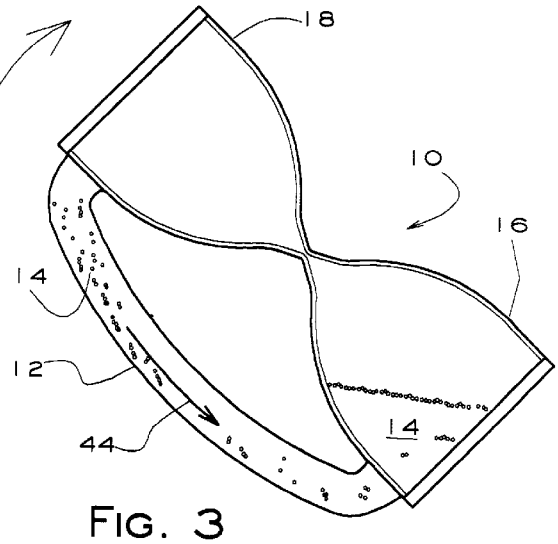
FIG. 3 illustrates the reset process started as shown in FIG. 2.

Turning now to FIGS. 2 and 3, it will be understood that in operation the user would start the timing process as carried out with a well known hourglass. Thus he would ensure that all of the sand or granular material 14 is held in one of the two reservoirs. Then the sand is allowed to flow from one of the reservoirs to the next reservoir through the constriction or necked duct 36. Before the transfer begins, upper reservoir holds an amount of sand that will take a predetermined amount of time to pass through the constriction. If, however, the user wishes to reset the hourglass before the completion of the transfer of the sand from one reservoir to the other, the user simply tilts the hourglass 10 as shown on FIG. 2 to allow the sand or granular material 14 to enter the bypass duct 12. The user simply tilts the hourglass 10 further to cause the sand to travel through the bypass duct 12 in the direction of arrows 38 to the reservoir 16 or 18 below, resetting the hourglass 10.

Figure 4:
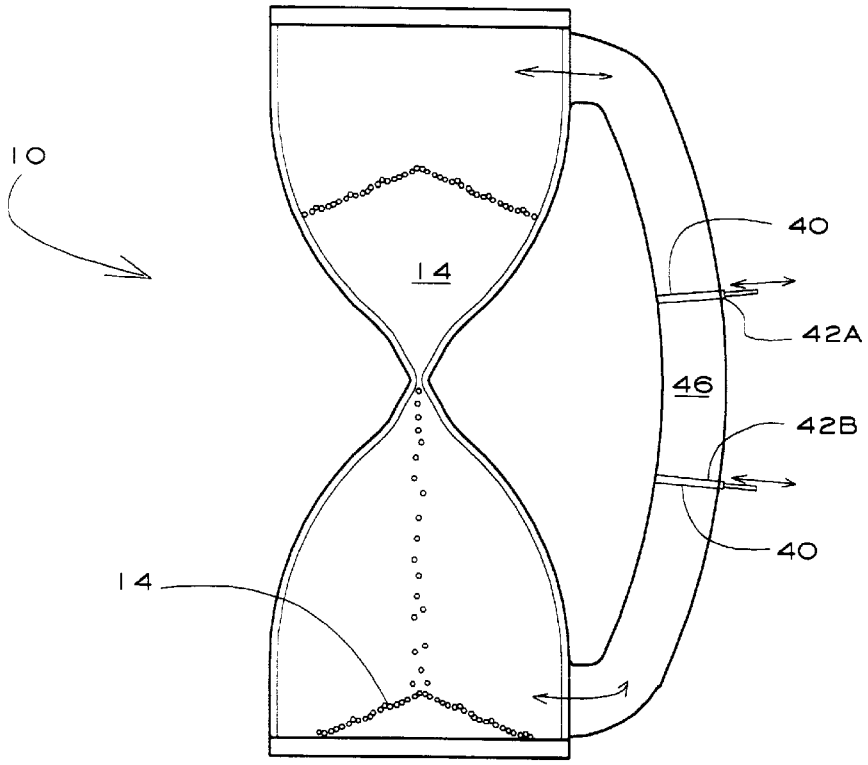
FIG. 4 is a variation of the highly preferred embodiment illustrated on FIG. 1, the variation including valves or gates that allow usage of the bypass duct as a sand measuring device.

Turning now to FIG. 4 it will be understood that the disclosed invention may be varied without departing from the true scope of the disclosed invention. For example, as shown on FIG. 4, it is contemplated that the bypass duct 12 of the hourglass 10 may include means 40 for capturing a portion of the granular material 14. In the illustrated example the means 40 consists of a adjustable valves 42A and 42B, such as a slide gate type valve which are movable in the direction of arrows 43. The slide gates operate in a conventional manner by partially or completely constricting the flow through the bypass duct 12.

The use of the means 40 to constrict or close off the bypass duct 12 provides the hourglass with the versatility of providing a means for adjusting the amount of time that is to be measured with the hourglass 10. For example, the positioning of the adjustable valves 42A and 42B along the bypass duct will define a chamber 46 of a predetermined volume of sand that represents an amount of time adjustment for the system. Therefore, if the chamber 46 holds an amount of sand representing five minutes of sand flow through the necked duct 36, the user can use this chamber 46 to capture or re-introduce this sand into the system by way of the means 40 to vary the time measuring ability of the hourglass 10.

Figure 5:
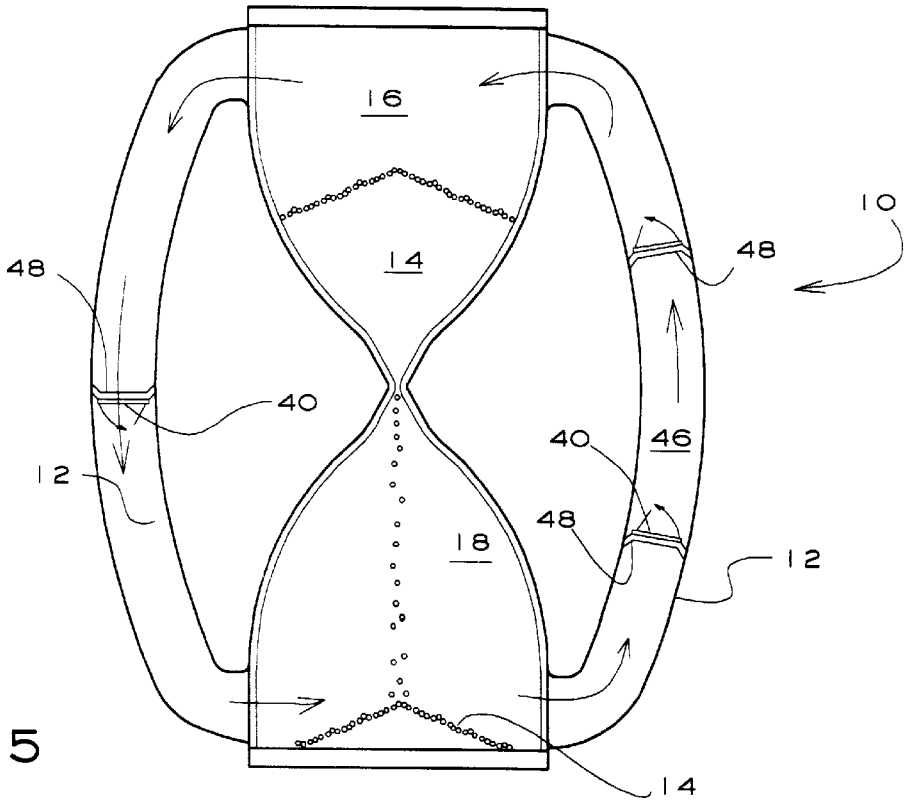
FIG. 5 is yet another variation of the invention, the illustrated variation including a pair of bypass ducts, each having a one way valve.

Referring now to FIG. 5, it will be understood that the invention can be further modified by adding more than one bypass duct 12. In the embodiment illustrated in FIG. 5, a pair of bypass ducts 12 have been incorporated on to the device. Furthermore, each illustrated bypass duct 12 includes a one-way valve 48. In the illustrated example of FIG. 5, the one-way valves 48 are of a flapper type valves were selected for this example due to their ease of use. A flapper valve will open in the presence of pressure from one side, but remain closed under pressure from the opposite side. In order to easily operate the time adjustment feature described in association with FIG. 4 (by holding a known or measured amount of sand within a chamber 46) while using one-way valves in the bypass duct 12, it would be advantageous to use the second bypass duct to facilitate the gathering of the desired amount of sand in the bypass duct 12 with the chamber 46.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An hourglass comprising:

a first reservoir having a collecting end and a transfer end, the transfer end being smaller than the collecting end;

a second reservoir having a collecting end and a transfer end, the transfer end being smaller than the collecting end;

a necked duct extending between the transfer end of said first reservoir and the transfer end of said second reservoir, the necked portion providing a restricted fixed flow path between the first reservoir and the second reservoir; and a bypass duct extending between the collecting end of said first reservoir and the collecting end of said second reservoir, the bypass duct having a valve that allows capture of an amount of material used to measure time with the hourglass, so that the amount of granular material held in said first reservoir will flow from the first reservoir through the transfer end of said first reservoir through the necked duct and into the transfer end of said second reservoir when said first reservoir is placed over said second reservoir, and so that granular material held near the collecting end of said second reservoir is transferred to the bypass duct and retained in the bypass duct by the valve by tilting the second reservoir to allow the granular material to enter the bypass duct, so that the granular material held in the bypass duct by the valve is used as reference for comparisons of time measurements and flow through the bypass duct to the collecting end of the first reservoir.

2. An hourglass according to claim 1 wherein the collecting end and the transfer end of the first reservoir are at a distance from one another, and the collecting end and the transfer end of the second reservoir are at a distance from one another, and the transfer end of the first reservoir and the transfer end of the second reservoir are between the collecting end for the first reservoir and the collecting end of the second reservoir.

3. An hourglass according to claim 2 wherein said bypass duct has a cross sectional area and said necked duct has a cross sectional area, and the cross sectional area of the bypass duct is several times the cross sectional area of the cross sectional area of the necked duct.

4. An hourglass according to claim 1 wherein said necked duct and said bypass duct are spaced apart from one another.

5. An hourglass comprising:

an amount of granular material;

a first reservoir having a collecting end and a transfer end, the transfer end being smaller than the collecting end;

a second reservoir having a collecting end and a transfer end, the transfer end being smaller than the collecting end;

a necked duct joining the transfer end of said first reservoir and the transfer end of said second reservoir, the necked portion providing a restricted fixed flow path for allowing a slow and fixed flow rate of granular material between the first reservoir and the second reservoir; and a bypass duct extending between the collecting end of said first reservoir and the collecting end of said second reservoir, the bypass duct having a valve, so that an amount of the granular material held in said first reservoir will flow from the first reservoir through the transfer end of said first reservoir through the necked duct and into the transfer end of said second reservoir when said first reservoir is placed over said second reservoir, and so that granular material held near the collecting end of said second reservoir is transferred to the bypass duct and temporarily retained in the bypass duct by the valve by tilting the second reservoir to allow the granular material to enter the bypass duct and flow through the bypass duct to the collecting end of the first reservoir.

6. An hourglass according to claim 5 wherein the collecting end and the transfer end of the first reservoir are at a distance from one another, and the collecting end and the transfer end of the second reservoir are at a distance from one another, and the transfer end of the first reservoir and the transfer end of the second reservoir are between the collecting end for the first reservoir and the collecting end of the second reservoir.

7. An hourglass according to claim 6 wherein said bypass duct has a cross sectional area and said necked duct has a cross sectional area, and the cross sectional area of the bypass duct is several times the cross sectional area of the cross sectional area of the necked duct.

8. An hourglass according to claim 5 wherein said necked duct and said bypass duct are spaced apart from one another.

9. An hourglass according to claim 5 wherein said bypass duct extends from the collecting end of said first reservoir to the collecting end of said second reservoir while extending away from said first reservoir and said second reservoir.

10. A method for storing, resetting and varying the amount of time measured by an hourglass, the method comprising:

providing an hourglass having:

a first reservoir having a collecting end and a transfer end, the transfer end being smaller than the collecting end;

a second reservoir having a collecting end and a transfer end, the transfer end being smaller than the collecting end;

a necked duct extending between the transfer end of said first reservoir and the transfer end of said second reservoir, the necked portion providing a restricted fixed flow path between the first reservoir and the second reservoir; and a bypass duct extending between the collecting end of said first reservoir and the collecting end of said second reservoir, the bypass duct having a valve; and tilting the hourglass so that an amount of granular material held in said first reservoir will flow from the first reservoir through the transfer end of said first reservoir through the necked duct and into the transfer end of said second reservoir when said first reservoir is placed over said second reservoir, and so that granular material held near the collecting end of said second reservoir is transferred to the bypass duct and selectively held in the bypass duct by the valve to allow use of the granular material as a time reference prior to flowing into to the collecting end of said first reservoir by tilting the second reservoir to allow the granular material to enter the bypass duct and flow through the bypass duct to the collecting end of the first reservoir.

11. A method according to claim 10 wherein the collecting end and the transfer end of the first reservoir are at a distance from one another, and the collecting end and the transfer end of the second reservoir are at a distance from one another, and the transfer end of the first reservoir and the transfer end of the second reservoir are between the collecting end for the first reservoir and the collecting end of the second reservoir.

12. A method according to claim 11 wherein each of said bypass ducts has a cross sectional area and said necked duct has a cross sectional area, and the cross sectional area of each of the bypass ducts is several times the cross sectional area of the cross sectional area of the necked duct.

* * * * *